United States Patent [19]

McPhail

[11] 4,274,468

[45] Jun. 23, 1981

[54] TRIPLE-SASH DOUBLE-HUNG STORM WINDOW

[76] Inventor: Shelvey C. McPhail, 4924 NW. 31st St., Oklahoma City, Okla. 73122

[21] Appl. No.: 73,916

[22] Filed: Sep. 10, 1979

[51] Int. Cl.[3] ..... A47H 1/00

[52] U.S. Cl. ..... 160/90; 52/202; 49/63

[58] Field of Search ..... 160/89, 90, 91, 92, 160/37; 49/61, 62, 63; 52/202

[56] References Cited

U.S. PATENT DOCUMENTS

| | | | |
|---|---|---|---|
| 1,462,644 | 7/1923 | Lancaster | 160/91 |
| 2,626,658 | 1/1953 | Milone | 160/101 |
| 2,640,535 | 6/1953 | Milone | 49/63 |
| 3,239,976 | 3/1966 | Hall | 160/90 |
| 3,587,705 | 6/1971 | Zappone | 160/91 |
| 3,908,730 | 9/1975 | Goss | 160/90 |
| 4,114,331 | 9/1978 | Yamamoto | 52/202 |

*Primary Examiner*—Nile C. Byers, Jr.

*Attorney, Agent, or Firm*—William R. Laney; C. Clark Dougherty, Jr.; Robert M. Hessin

[57] ABSTRACT

A triple-sash double-hung storm window assembly which includes a flanged, multiple channeled extrusion of generally rectangular overall configuration. The primary window or first sash of the assembly is the conventional double-hung window built into the house, and the flange of the multi-channeled extrusion is secured to a framing element which surrounds the conventional window at its outer side. The extrusion defines two staggered or offset compound channels forming an intermediate sash and an outer sash. The compound channel which defines the outer sash is peripherally inset from the compound channel defining the intermediate sash so that window and screen elements mounted in the outer sash can be mounted and demounted from the interior of the house, first through the intermediate sash and then through the conventional double-hung window.

19 Claims, 5 Drawing Figures

TRIPLE-SASH DOUBLE-HUNG STORM WINDOW

BACKGROUND OF THE INVENTION

1. Field of the Invention

This invention relates to storm windows, and more particularly, to multiple sash, double-hung storm windows mountable over the existing window openings of a house.

2. Brief Description of the Prior Art

It has been heretofore proposed to provide double-sash window structures which function as effective transparent thermal barriers which enhance the weathertightness of conventional windows.

Triple-sash windows have also been proposed in which storm sash windows are mounted over a window opening from the exterior of the house.

A prior art statement is submitted separately from this application in compliance with 37 C.F.R. Sections 1.56, 1.97 and 1.98.

BRIEF DESCRIPTION OF THE PRESENT INVENTION

The present invention provides an improved storm window construction which features a triple-sash, double-hung construction into which window and screen panels are mountable and demountable from the interior of the house.

Broadly described, the storm window of the invention comprises a multiple channeled, double sash rectangular frame which has a peripheral mounting flange for mounting the storm window over a conventional window opening. The window opening frames a conventional window panel. The conventional window sash forms the third sash of the triple-sash construction. The multiple channeled, double-sash rectangular frame includes a pair of substantially parallel side framing plates which are interconnected by a top plate, and which rest upon, or are secured to, a sill plate. The side and top framing plates are connected at one edge to the peripheral mounting flange, and project normal thereto and to the plane of the conventional window panel.

The double-sash construction includes an intermediate and an outer sash, and each of these sashes includes a pair of sash side channels, each of which extends along the two side framing plates. The intermediate sash further includes a pair of top channels which extend between the side channels of the inner sash in coplanar alignment therewith. The channels of the intermediate and outer sashes are staggered or offset in their spatial arrangement relative to the side framing plates, and relative to each other, so that the channels of the outer sash surround and define an opening which is of smaller length and width than the opening defined by the channels of the intermediate sash.

The described construction in which the channels of the intermediate and outer sashes are staggered or offset in their spatial arrangement relative to the side framing plates and relative to each other facilitates the mounting and removal of window light assemblies and screen panel assemblies from these sash channels, as carried out from the inside of the housing upon which the multiple channeled double-sash rectangular frame is mounted. Maintenance and seasonal change-out of the panels is thus facilitated. Moreover, the multiple sashes and their associated window light panel assemblies assure a high degree of weathertight integrity to prevent thermal transfer through the assembly.

An important object of the invention is to provide an improved triple-sash, double-hung storm window assembly which is relatively simple in its construction, can be made entirely of extruded metal, and is of light weight and easily mounted over an existing window opening.

A further object of the invention is to provide a triple-sash, double-hung storm window assembly in which the two outer sashes of the triple-sash receive and accommodate window light panels inserted into channels in the two outer sashes from inside the house, and thus do not require external assembly.

A further object of the invention is to provide a triple-sash, double-hung storm window which is versatile in its construction and utilization, allowing one or more of the sashes to be selectively employed, either alone or in combination.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
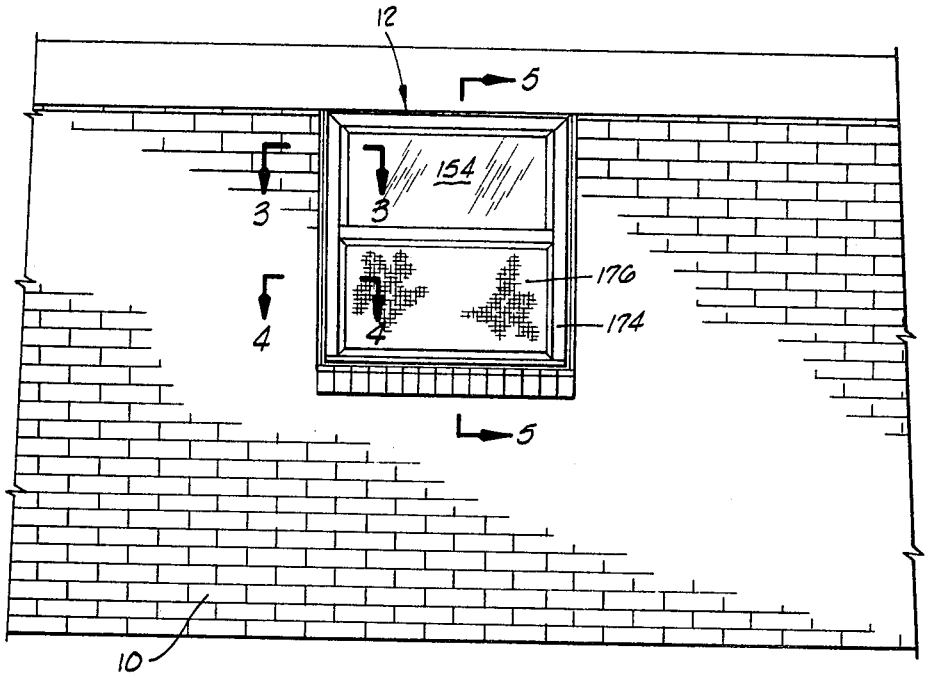
FIG. 1 is a side elevation view of the side of a home in which the triple-sash, double-hung storm window assembly of the present invention is mounted.

The brick veneer wall 10 of a home is provided with a conventional window opening 11 in which is mounted the triple-sash, double-hung storm window assembly 12. The triple-sash, double-hung storm window assembly 12 includes a conventional window sash designated generally by reference numeral 14, and shown in part in FIGS. 3 and 5. The conventional window sash 14 will be hereinafter referred to as the primary or inner sash, and includes a conventional double-hung window partially illustrated in FIGS. 3 and 4. The window comprises an upper window panel assembly 15 which includes a side frame member 16 notched as shown at 18 to receive a glass pane or panel 20 which is secured in position by glazing 22. The side frame member 16 is slidably retained in the window opening by means of facing strips 24 which are secured to a window framing element 26 mounted in the window opening in conventional fashion. The window of the inner sash also includes a conventional lower window panel assembly (not shown) which is constructed similarly to the lower window panel assembly 15.

The storm window assembly 12 further includes a multiple channeled, double-sash rectangular frame which is open at its lower side and is designated generally by reference numeral 28. The double-sash frame 28 is preferably made of several sections of extruded metal, as hereinafter explained, and includes a peripheral mounting flange 30 which extends around the sides and top of the rectangular frame and lies in a plane which projects parallel to the plane of the window pane 20. The double-sash rectangular frame 28 is secured in the window opening by means of a plurality of screws 32 which are extended through apertures in the mounting flange 30, through a sealing strip 31 and into the facing strip 24.

The rectangular frame 28 further includes a pair of opposed, horizontally spaced, substantially parallel extruded metal side framing plates 34 which extend parallel to each other and are located on opposite sides of the window opening. The side framing plates 34 in the illustrated embodiment of the invention are spaced outwardly from the framing element 26 and the space between these structures can be filled with any suitable sealant if desired. Moreover, each side framing plate 34 defines an offset which ends in a shoulder 35. The shoulder and mounting flange 30 define a space which receives a foamed synthetic resin sealing strip hereinafter described. The side framing plates 34 are interconnected at their upper ends by a horizontally extending top plate 36 which extends normal to each of the side framing plates, and is a separate extruded structure from the side framing plates. The top plate 36 is joined to the side framing plates 34 at the corners of the rectangular frame by mitered joints secured by means of screws (not shown). The screws are engaged by extruded screw eyes 38 and 40 formed on the extrusions which form the side framing plates 34, and screw eyes 42 and 44 carried by the extrusion which forms the top plate 36.

Each side framing plate 34 carries a plurality of parallel flanges which define two pairs of contiguous open tracks or channels facing inwardly with respect to the center of the window opening. Thus, an inwardly extending flange 46, which is in coplanar alignment with the mounting flange 30, and an intermediate flange 48 which extends normal to the respective side framing plate 34 define between them a vertically extending side channel 50. Each flange 46 has a notch or recess 49 in its inner edge and located approximately one-fourth of the way from the bottom to the top of the respective flange. Similarly, each intermediate flange 48 defines a notch or recess 51 in its inner edge about one-fourth of the way from the bottom of the flange to the top and in substantially horizontal alignment with the recess 49. A contiguous vertically extending side channel 52 is defined by the intermediate flange 48 and a flange 54 which is spaced horizontally outwardly from the intermediate flange and extends normal to the respective side framing plate 34. It will be noted that the outer flange 54 extends further into the window opening or, stated differently, has a greater transverse width than the intermediate flange 48. The two opposed, horizontally spaced, vertically extending side channels 50 and 52, in conjunction with channels formed in the top plate 36, and hereinafter described, function to hold the two window light assemblies located in the first or innermost of the two sashes of the double-sash construction of the rectangular frame 28.

In coplanar alignment with the two channels 50 and 52 carried by each of the extruded metal side framing plates 34 are a pair of contiguous, horizontal channels 58 and 60 which extend along the top plate 36. The channel 58 is defined by an inwardly extending flange 62 which is in coplanar alignment with the flange 46, and with the mounting flange 30. The channel 60 is defined between an intermediate flange 64 and an outer flange 66. The outer flange 66, like the flange 54, projects further into the window opening than the flanges 62 and 64.

Figure 3:
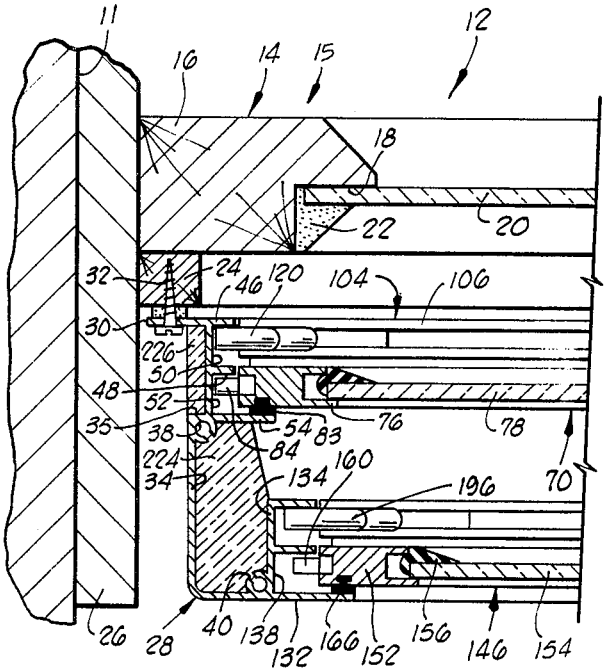
FIG. 3 is a sectional view taken along line 3—3 of FIG. 1.

The channels 52 and 60 which are carried on the side framing plates 34 and the top plate 36 function to receive an upper window light assembly designated generally by reference numeral 70. The upper window light assembly 70 includes a frame extending around the outer side thereof, which frame includes a top frame member 72, a bottom frame member 74 and a pair of substantially parallel, vertically extending side frame members 76. Each of the frame members 72, 74 and 76 is channeled at its inner side to facilitate mounting a glass panel 78 within the frame formed by these frame members. The glass panel 78 is sealed by glazing strips 80 in the channels of the framing members which receive the top, bottom and side edges of the glass panel. A cushioning sealing strip 81 includes a portion engaged by a T-shaped slot in the top frame member 72 and bears sealingly against the flange 66. Similarly, cushioning sealing strips 83 are carried on the side frame members 76 and bear sealingly against the flanges 54 as shown in FIG. 3.

To permit the upper window light assembly 70 to be mounted in the channels 52 carried on the side framing plates 34, the upper window light assembly carries a pair of outwardly projecting guide pins 82 at opposite ends of the top frame member 72, which pins project outwardly from the side frame members 74 into the two opposed channels 52. Substantially midway of the length of each of the side frame members 76, each of these members carries a locking peg 84. The two locking pegs 84 are passed through the small recesses 48 formed in the intermediate flanges 48 at a time when the upper window light assembly 70 is being slidably mounted in the channels 52 as hereinafter described. At the opposite ends of the lower frame member 74, a pair of latches 86 are slidably mounted in receiving channels 88 provided in the bottom frame member, and are each spring-loaded by a suitable spring (not shown) to resiliently bias the latching elements laterally into engagement with the framing plates 34.

A spacer frame designated generally by reference numeral 90 is located beneath the upper window light assembly 70 in the channels 52 carried by the side framing plates 34. The spacer frame 90 includes a pair of substantially parallel side spacer plates 92, a top spacer plate 94 and a bottom spacer plate 96. The spacer frame 90 is retained in the channels 52 by locking pegs 98 which project laterally from the mid-portion of each of the parallel side spacer plates 92.

A lower window light assembly 104 is slidably positioned in the lower portion of the channels 50 defined between the intermediate flange 48 and the inwardly extending flange 46. The lower window light assembly is constructed very similarly to the upper window light assembly 70, and includes a top frame member 106, a bottom frame member 108 and a pair of parallel side frame members 110. A glass panel 112 is located centrally within the frame of the lower window light assembly and has side, top and bottom edges which extend into channels formed in the side frame members 110, top frame member 106 and bottom frame member 108, respectively. Elastomeric glazing strips 114 are used to retain the glass panels in the frame of the lower window light assembly. Each of the side frame members 110 has a cushioning sealing strip extended partially into and engaged with a T-shaped channel formed in the side frame members, with the cushioning sealing strip projecting rearwardly from the respective side frame member and bearing against the spacer frame 90. A similarly shaped cushioning sealing strip 118 extends into and engages a T-shaped channel formed in the top frame member 106, and bears sealingly against the spacer frame 90.

In order to mount the lower window light assembly 104 in the channels 50 carried on the side framing plates 34, the side frame members 110 carry outwardly projecting guide pins 120, and a pair of locking pegs 122 project outwardly from a central portion of the side frame members 110 into the channels 50. A pair of slidable latches 124 are carried at the opposite ends of the bottom frame member 108 and are resiliently biased by a suitable spring (not shown) to their outwardly extending positions where they can be selectively engaged with the side framing plates 34 to lock the lower window light assembly 104 in a selected vertical position within the channels 50. A resilient cushioning and sealing strip 126 is secured on the lower side of the bottom frame member 108.

For the purpose of mounting two window light assemblies which are located in the second or outer of the two sashes of the double-sash construction of the rectangular frame 38, each of the side frame plates 34 further carries a plurality of parallel outer flanges which together define a second pair of vertically extending contiguous open tracks or side channels facing inwardly with respect to the window opening, and spaced horizontally outwardly from the channels 50 and 52 hereinbefore described.

Thus, an inwardly extending outer sash internal flange 128 is secured to one end of a reverse turned web plate 130 which extends parallel to the adjacent side framing plate 34. The inwardly extending outer sash internal flange 128 extends normal to one end of the web plate 130. At its opposite end, the web plate 130 is secured to the mid-portion of a laterally extending outer outer sash external flange 132. The outer sash external flange 132 is the means by which the web plate 130 and the flanges carried thereon are joined to the framing plate so that these flanges lie in planes which extend substantially normal to the plane of the side framing plate 34.

It will be noted that the outer sash external flange 132 projects further inwardly into the window opening than does the outer sash internal flange 128, similarly to the relationship of the inwardly extending flange 46 and the flange 54 associated with the inner sash of the multiple channeled, double-sash rectangular frame 28. Extending from a mid-portion of the web plate 130 and disposed approximately midway between the outer sash internal flange 128 and the outer sash external flange 132 is an outer sash intermediate flange 134. The outer sash internal and intermediate flanges 128 and 134, respectively, define between them a first outer sash channel 136. The intermediate flange 134 and outer sash external flange 132 define between them a second outer sash channel 138.

Figure 4:
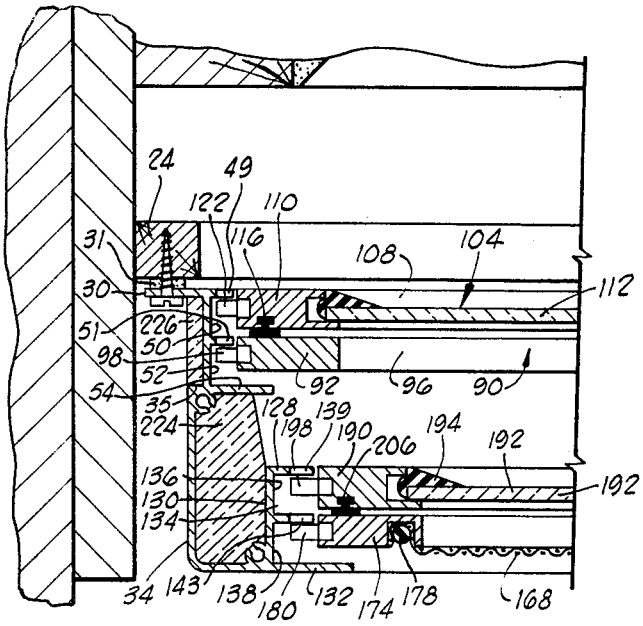
FIG. 4 is a sectional view taken along line 4—4 of FIG. 1.

It should be noted that the outer sash flanges and channels defined thereby which are associated with one of the side framing plates 34, as depicted in FIG. 4, have a counterpart, identical construction on the opposite side of the multiple channeled, double-sash rectangular frame 28 where the identical channels and flanges are formed in association with a web plate 130 located toward the outer terminal edge of the corresponding, opposite side framing plate 34, and joined to that side framing plate by an identical outer sash external flange 132.

The outer sash internal flanges 128 each have a notch or recess 139 therein about one-fourth of the distance from the lower end to the upper end of the flanges. Similarly, the intermediate flanges 134 are notched at 143 at a position spaced one-fourth of the distance from the bottom to the top of each of these flanges, and in horizontal alignment with the recesses 139.

It will be noted in referring to FIG. 4 that the flanges 128, 132 and 134, which, as will be described, are provided for mounting the two outer window light assemblies and a protective screen, are inset, in their relation to the window opening, from the position occupied by the flanges 46, 48 and 54 and the channels 50 and 52 defined therebetween as these elements are associated with and form the inner sash of the multiple channeled, double-sash rectangular frame 28. Stated differently, the flanges 128, 132 and 134, forming parts of the outer sash, project further from the respective side framing plate upon which they are mounted toward the other side framing plate than do the flanges 46, 48 and 54.

The top plate 36 has secured to its outer edge a downwardly extending outer sash external flange 140. The outer sash external flange 140 is extruded integrally with a web plate 142 which projects toward the upper window light assembly 70 and carries at its inner edge an outer sash internal flange 144 which projects downwardly and perpendicularly with respect to the web plate 142.

Mounted within the upper portion of the two opposed parallel channels 138 in the outer sash is an upper window light assembly 146. The upper window light assembly 146 includes a top frame member 148, a bottom frame member 150 and a pair of vertically extending, substantially parallel side frame members 152 which collectively form a rectangular frame in which a glass panel 154 is mounted. The side edges of the glass panel 154 extend into recesses or channels formed in a top frame member, bottom frame member and side frame members, and the glass panel is retained in these channels by elastomeric glazing strips 156.

At the opposite ends of the top frame member 148, a pair of outwardly projecting guide pins 158 are extended laterally from the top frame member and are slidably positioned within the channels 138 disposed at opposite sides of the outer sash portion of the multiple channeled, double-sash rectangular frame 28. Outwardly projecting locking pegs 160 are secured to the outer sides of each of the side frame members 152 at the mid-portion thereof, and also slidably engage the channels 138 at opposite sides of the window opening. A pair of spring-biased, slidable latches 162 are slidably mounted in suitable slots or recesses in the opposite ends of the bottom frame member 150, and are retractably extended into the channels 138 carried on the two side framing plates 34.

A cushioning sealing strip 164 is carried at the outer side of the top frame member 148 by engagement of a T-shaped tongue forming a part of the cushioning and sealing strip with a T-shaped slot or channel formed in the outer side of the top frame member. Similarly, cushioning sealing strips 166 are carried on the side frame members 152 of the upper window light assembly 146 and sealingly bear against the flange 132.

The upper window light assembly 146 of the outer sash rests at its lower side upon a screen panel assembly, designated generally by reference numeral 168. The screen panel assembly 168 includes a top frame member 170 which supports the upper window light assembly 146, a bottom frame member 172 and a pair of substantially parallel vertically extending side frame members 174, with such frame members together forming a rectangular frame open at the center. A screen panel 176 fills the opening in this frame, and the outer edges of the screen panel extend into channels formed in the top, bottom and side frame members 162, 164 and 166, respectively, and are retained in these channels by means of resilient retaining beads 178.

The screen panel assembly 168 is retained in the opposed, second outer sash channels 138 similarly to the window light assemblies hereinbefore described. Thus, the screens include a pair of outwardly projecting locking pegs 180 which extend from the medial portions of the side frame members 174 and pass at their lower ends into the channels 138.

A lower window light assembly carried in the outer sash of the multiple channeled, double-sash rectangular frame is designated generally by reference numeral 184. The lower window light assembly is constructed substantially identically to, although it is smaller in transverse dimension than, the lower window light assembly 104 hereinbefore described. It thus includes a top frame member 186, a bottom frame member 188 and a pair of opposed, substantially parallel side frame members 190. Within the rectangular framework formed by these frame members, a glass panel 192 is mounted by means of elastomeric glazing strips 194. At the opposite ends of the upper frame member 186, a pair of guide pins 196 project outwardly and engage the channels 134. A pair of locking pegs 198 project laterally from the mid-portions of the side frame members 190 into the channels 134. The locking pegs 198 cooperate with spring-biased latches 200 slidably mounted in suitable slots at the opposite ends of the lower frame member 188, and resiliently urged by springs (not shown) outwardly to the point where the outer ends of the latches engage the channels 136. A cushioning sealing strip 204 extends transversely across the upper frame member 188 and is secured thereto by a T-shaped neck which extends into a slot of complementary shape formed in the upper frame member. The cushioning sealing strip 204 bears sealingly against the top frame member 170 of the screen panel assembly 168. Similar cushioning sealing strips 206 are provided at the outer side of the side framing members 190 and are similarly mounted by means of T-shaped grooves formed in these frame members. An elastomeric sealing pad 208 is secured to the bottom frame member 188 and extends transversely across the window opening.

Figure 5:
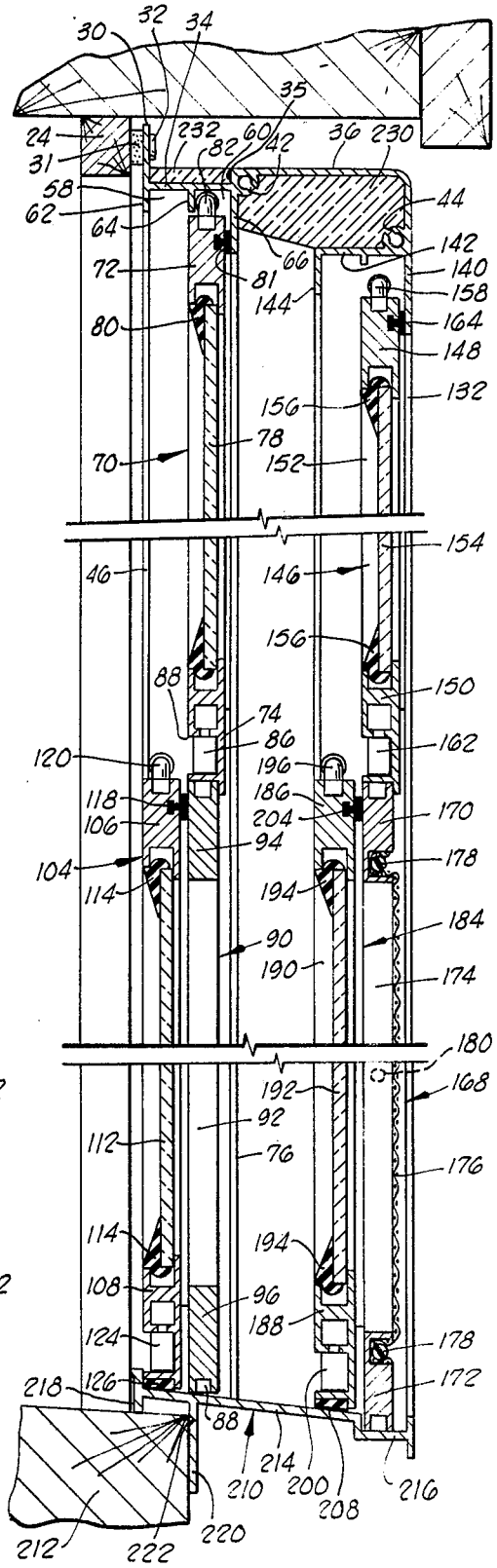
FIG. 5 is a sectional view taken along line 5—5 of FIG. 1.

For the purpose of supporting the multiple channeled, double-sash rectangular frame 28 within the window opening, and more particularly, to provide a base for the several window light assemblies and the screen panel assembly to rest upon, an extruded metal sill plate, designated generally by reference numeral 210, is provided in the location shown in FIG. 5. Thus, the sill plate 210 is positioned below the multiple channeled, double-sash rectangular frame 28 and is supported, at its inner edge portion, upon the conventional wooden window sill 212 which is disposed below the conventional window sash 14. The sill plate 210 includes a downwardly and outwardly inclined base panel 214 which terminates at its outer edge in an upwardly opening channel element 216, and at its inner edge in a vertically extending stop plate 218.

Spaced outwardly from the stop plate 218 is a vertical guide flange 220 which projects downwardly from the base panel 214 and functions to register the sill plate 210 with the existing conventional wooden window sill 212 when the triple-sash, double-hung window assembly 12 is mounted in the manner shown in the drawings. The guide plate 220 is, however, scored from its opposite sides as shown at 222 to permit the bottom portion of the guide plate to be broken away, and thereby facilitate the mounting of the sill plate flatly upon the upper side of a conventional window sill in some types of installation where this is desirable.

The sill plate 210 extends transversely completely across the window opening, and is joined at its opposite ends to the extruded metal side framing plates 34 of the multiple channeled, double-sash rectangular frame 28. The sill plate 210 functions to support the lower frame members of the lower window light assemblies 90 and 184 and the screen panel assembly 168. Thus, it will be noted that the bottom frame member 172 of the screen panel assembly 168 rests in the channel element 216 and that the sealing member 208 carried on the bottom frame member 188 of the lower window light assembly 184 rests upon, and seals against, the upper surface of the base panel 214 of the seal plate 210. Similarly, the bottom spacer plate 96 of the spacer frame 90 rests upon the upper side of the base panel 214, and the seal member 126 carried on the lower side of the bottom frame member 108 of the lower window light assembly 104 also rests upon the upper surface of the base panel and bears at one side against the stop plate 218.

In order to provide enhanced weathertight integrity in the triple-sash, double-hung window assembly of the invention, a thick strip of foamed synthetic resin insulation 224 is provided in each space which is defined between the reverse turned web plates 130, the side framing plates 34 and the flanges 54 at opposite sides of the double sash frame 28. Similarly, a strip of foamed synthetic resin insulation material 226 is pressed into the channel which is defined by the offset in each side framing plate 34 adjacent its point of connection to the inwardly extending flange 46.

At the upper side of the multiple channeled, double-sash rectangular frame 28, a similar thick strip of foamed synthetic resin insulation material 230 is placed in the space defined between the web plate 142, the downwardly extending outer sash external flange 140 and the top plate 36. A foamed synthetic resin insulation material strip 232 is also pressed into the offset within the top plate 36 as shown in FIG. 5.

An important aspect of the present invention is the structural configuration of the triple-sash, double-hung window assembly which permits the outer double sash elements to be placed in operative position and removed for maintenance and repair, all from the inside of the house. At the time when the outer double-hung window assembly is to be mounted over the window opening in which a conventional window sash 14 is already located, the multiple channeled, double-sash rectangular frame 28 is first placed in position by extending the screws 32 through the peripheral mounting flange 30 and the sealing strips 31 into the facing strip 24 around the window opening. The multiple channeled, double-sash rectangular frame 28 is mounted conjunctively with the sill plate 210 and, in fact, the sill plate may be joined by suitable screws to the side framing plates 34 of the double-sash rectangular frame prior to the time that such frame is mounted to the facing strips 24 by the use of the screws 32.

After the sill plate 210 and the multiple channeled, double-sash rectangular frame 28 have been set into position, the various window light assemblies and the screen assembly are placed in position.

Initially, the upper window light assembly 146 located in the outer sash is passed through the open primary window mounted in the conventional window sash and out through the central opening defined in the inner side of the multiple channeled, double-sash rectangular frame 28. When the outer sash portion of the frame is reached, the upper window light assembly 146 is tilted or canted, and also leaned outwardly, so that the outwardly projecting guide pins 158 are also canted or angled and can thus be moved into the opposed, substantially parallel second outer sash channels 138. At this time, the lower portion of the upper window light assembly 146 is still located on the inner side of the outer sash internal flanges 128 which carry the notches or recesses 139. It will be recalled that these recesses are aligned with the recesses 143 in the outer sash intermediate flanges 134.

Figure 2:
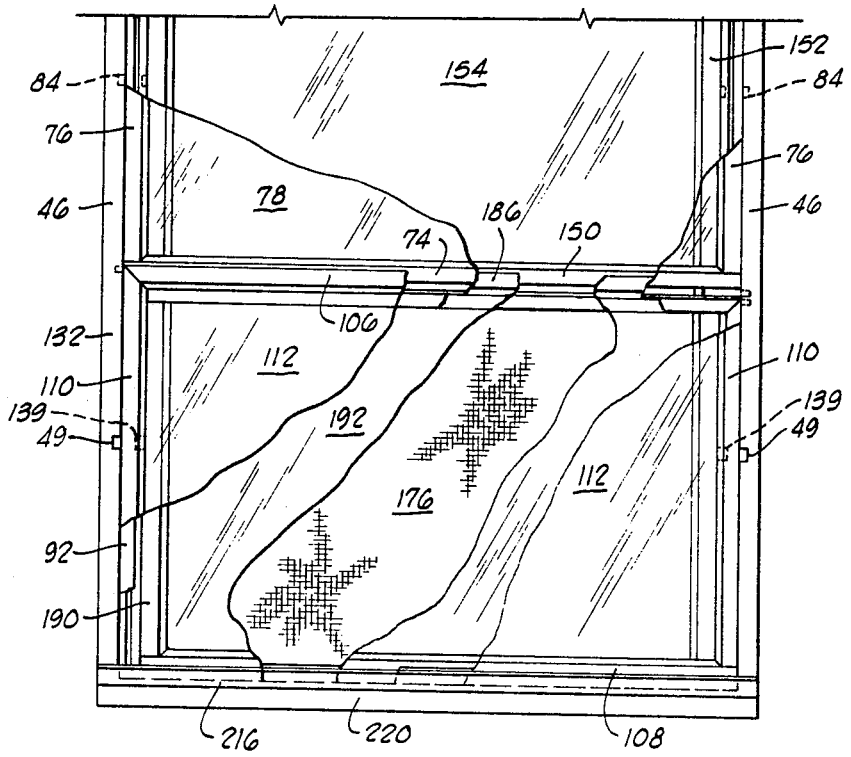
FIG. 2 is an enlarged elevation, with parts broken away and the conventional window sash omitted, of the triple-sash, double-hung storm window assembly of the invention.

At this time, the angulation is removed to allow the locking pegs 160 to pass first through the recesses 139 in the lower portion of the outer sash internal flanges 128, and then through the aligned recesses 143 in the lower portion of the outer sash intermediate flanges 134. By this means, accomplished while the spring-biased latches 162 are retracted so that the outer ends thereof are inside the inner edge of the intermediate flanges 134 as well as the inner edges of the internal flanges 128, the upper window light assembly 146 which is to be located in the outer sash is brought into coplanar alignment with the second outer sash channels 138. The spring-biased latches 162 are then released to allow the outer ends of these latches to slidably interlock with the second outer sash channels 138. By selective retraction of the spring-biased latches 162, the upper window light assembly 146 can then be moved upwardly to its normal operative position in the upper portion of the channels 138 as illustrated in FIGS. 1–3. When the spring-biased latches 162 are then released, the upper window light assembly will be retained in this position.

The screen panel assembly 168 can then be placed in position at the outer side of the multiple channeled, double-sash rectangular frame 138 by passing it out through the open window and out through the relatively large opening defined at the inner side of the multiple channeled, double-sash rectangular frame which is surrounded by the inner sash elements. The locking pegs 180 carried on the screen panel assembly 168 are then passed through the aligned recesses 139 and 143 located in the lower portions of the outer sash internal flanges 128 and the outer sash intermediate flanges 134, respectively. After the locking pegs 180 have passed through these notches or recesses, the screen panel assembly 168 is moved into the substantially parallel, vertically extending second outer sash channels 138 in the lower portion thereof. Here the bottom frame member 172 of the screen panel assembly 168 rests in the channel element 216 of the sill plate 210. The upper portion of the screen panel assembly 168 is retained in position by the downwardly projecting flange 153 carried on the bottom frame member 150 of the upper window light assembly 146.

After the upper window light assembly 146 and the screen panel assembly 168 have been located in their receiving channels 138 in the outer sash in the manner described, the lower window light assembly 184 of the outer sash is passed through the open primary window, out through the opening between the inwardly extending flanges 46 and into a position where this lower window panel assembly is angled laterally with respect to the first outer sash channels. By proper angling, the guide pins 196 can be caused to align with the opposed vertically extending, first outer sash channels 136, and then made to enter those channels by removing the angulation between the window light assembly and the channels.

After this has been accomplished, the locking pegs 198 carried at the mid-portions of the side frame members 190 of the lower window light assembly 184 are aligned with the recesses or notches 139 formed in the lower portion of the outer sash internal flanges 128. When such alignment exists, the spring-biased latches 200 can be retracted inwardly to allow the lower end of the lower window light assembly 184 to be pushed into coplanar alignment with the vertically extending outer sash channels 136. The spring-biased latches 200 are then released to allow the outer ends thereof to snap into the first outer sash channels 136, and the window light assembly 184 is then allowed to slide downwardly in these channels until the elastomeric sealing pad comes to rest upon the upper side of base panel 214 of the sill plate 210. When the lower window light assembly 184 is in its lowered or closed position, the cushioning strips 204 and 206, along with the sealing pad 208, provide weather-tight integrity in the manner hereinbefore described.

It will be apparent that the upper and lower window light assemblies 146 and 184 can be removed from the inside of the house in the same manner that they are installed, i.e., by withdrawing them through the large opening at the inner portion of the multiple channeled, double-sash rectangular frame, and then through the open primary window of the conventional window sash. Maintenance or removal during warm months, if desired, is thus facilitated, and can be accomplished without the necessity of going outside the house.

The inner sash upper window light assembly 70 is mounted in substantially the same way as that used in mounting the outer sash upper window light assembly. Thus, the inner sash upper window light assembly 104 is initially passed out through the open conventional window, and is then canted or tilted so that the outwardly projecting guide pins 82 can be canted or angled into the opposed, substantially parallel vertically extending side channels 52. The frame of the inner sash upper window light assembly 70 is then straightened up and the lower portion thereof is pivoted toward a vertical plane until the locking pegs 84 carried on the side frame members 76 are aligned with the recesses 49 formed in the lower portion of the inwardly extending flanges 46 and the registering recesses 51 formed in the lower portion of the intermediate flanges 48. The bottom portion of the frame of the inner sash upper window light assembly 104 is then further pushed toward alignment with a vertical plane so that the locking pegs 84 carried on the side frame members pass through the aligned recesses 49 and 51 and into the channel 52 formed on the outer side of the intermediate sash. During this movement, the retractable latches 88 are retracted in their receiving channels 90 against the bias of springs (not shown) to allow the lower end portion of the upper window light assembly 104 to clear the inner edges of the flanges 46 and 54. After the inner sash upper window light assembly 104 has been thus placed in the vertically extending side channels 52, it is slid upwardly in these channels until the top frame member 72 thereof is at a location relatively near the top plate 36 of the multiple channeled, double-sash rectangular frame 28.

After the inner sash upper window light assembly 70 is positioned so that it is slidably mounted in the upper portions of the parallel vertically extending side channels 52, the spacer frame 90 is positioned beneath it in the same channels. This is accomplished by substantially the same method as that used to mount the inner sash upper window light assembly 70 in these channels.

The final assembly to be placed in the multiple channeled, double-sash rectangular frame is the inner sash lower window light assembly 104. The window light assembly 104 is, as in the case of the other window light assemblies, passed out through the open conventional window, and is then canted or tilted laterally so that the outwardly projecting guide pins 120 carried thereon can be swung into the opposed, substantially parallel vertically extending side channels 50. The locking pegs 122 are then passed through the aligned recesses 49 and 51 to bring the lower window light assembly 104 into alignment with a vertical plane. At this time, the sides of the lower window light assembly are aligned with the parallel vertically extending side channels 52. During this positioning of the lower window light assembly 104, the slidable latches 124 are retracted to facilitate the necessary clearance of the flanges 46 and 48. When the lower window light assembly 104 is thus positioned, the sealing strip carried at the lower side thereof rests upon the base panel 214 of the sill plate 210, and the cushion sealing strips 116 and 118 bear against the spacer frame 90.

From the foregoing description of the invention it will be perceived that an energy-efficient triple-sash, double-hung window assembly of the invention is provided, and that such an assembly is convenient and easy to utilize as seasonal changes may dictate the desirability of eliminating one or more of the sashes and associated window light assemblies. Although certain preferred embodiments of the invention have been herein described in order to clearly illustrate the basic principles which underlie the invention, changes and innovations can be made in the structure illustrated as a typical preferred embodiment of the invention without departure from these principles. For example, instead of using a screen panel assembly 168 of the construction shown in FIG. 5 and herein described, a screen panel assembly of the type depicted in my co-pending U.S. application Ser. No. 60,787, and having a heavy expanded metal grille at the outer side thereof to deter burglarization of the home, and to afford better protection to the screen panel 176 and glass panel 192 of the lower window light assembly 184, can be utilized if desired. Changes and innovations of this type, as well as others, which continue to rely upon the basic principles of the present invention are therefore deemed to be circumscribed by the spirit and scope of the invention except as the same may be necessarily limited by the appended claims or reasonable equivalents thereof.

What is claimed is:

1. A triple-sash, double-hung window assembly comprising:

a first, generally rectangular inside window sash adapted for mounting within the window opening in the wall of a house;

an inside sash upper window panel assembly mounted in the upper portion of said first, inside window sash;

an inside sash lower window panel assembly slidably mounted in the lower portion of said first, inside window sash for vertical sliding movement in said inside window sash;

a framing element extending around said inside window sash;

a facing strip secured to said framing element and spaced horizontally from, and extending around the perimeter of, said first inside window sash;

a multiple channeled, double-sash rectangular frame which includes:

a peripheral mounting flange secured to said facing strip;

a pair of vertically extending, horizontally spaced, substantially parallel side framing plates each secured to, and extending substantially normal to, said peripheral mounting flange, lying in planes extending normal to said inside window sash;

a horizontally extending top plate extending across and interconnecting the upper ends of said side framing plates;

a first series of three substantially parallel, vertically extending flanges secured to, and projecting substantially perpendicularly from, each of said side framing plates and toward the other of said side framing plates, each of said first series of three substantially parallel flanges defining a pair of contiguous intermediate sash side channels which form a portion of an intermediate window sash, the pair of intermediate sash side channels associated with one of said side framing plates being in coplanar alignment with a pair of intermediate sash side channels associated with the other of said side framing plates;

a second series of three substantially parallel flanges secured to, and projecting substantially perpendicularly from, said top plate and defining a pair of contiguous intermediate sash upper channels forming a portion of an intermediate window sash, the pair of contiguous intermediate sash upper channels associated with said top plate being in coplanar alignment with the pair of intermediate sash side channels associated with each of said side framing plates;

a third series of three substantially parallel flanges each associated with each of said side framing plates, each of said flanges in each of said third series projecting in a plane which extends substantially normal to each of said side framing plates, and each connected to one of said side framing plates and projecting therefrom toward the other of said side framing plates, each of said third series of flanges being positioned on its respective side framing plate nearer to the other of the two side framing plates than are the flanges in said first series of flanges carried on the same side plate, each of said third series of flanges defining a pair of contiguous outer sash side channels forming a portion of an outer window sash, the pair of contiguous outer sash side channels associated with one of said side framing plates being in coplanar alignment with the pair of outer sash side channels associated with the other of said side framing plates, said outer sash side channels being spaced horizontally from said intermediate sash side channels, and being disposed a lesser horizontal distance from each other than said intermediate sash side channels; and at least two parallel flanges disposed in a fourth series of flanges projecting perpendicularly from said top plate and spaced horizontal from said second series of flanges on said top plate, said parallel flanges in said fourth series of flanges projecting vertically downward from said top plate by a greater distance than the flanges in said second series of flanges, and said fourth series of flanges defining at least one outer sash upper channel, said outer sash upper channel being in coplanar alignment with one of the outer sash side channels associated with each of said side framing plates;

an intermediate sash upper window light assembly dimensioned to pass through the opening in said rectangular inside window sash when said lower window panel assembly of said inside sash is slid vertically to an open position, said intermediate sash upper window light assembly including means removably and slidably supporting said intermediate sash upper window light assembly in the upper portion of the ones of said intermediate sash side channels associated with each of said side framing plates which are spaced the farthest from said inside sash of said two contiguous intermediate sash side channels;

an intermediate sash lower window light assembly dimensioned to pass through the opening in said rectangular inside window sash when said lower window panel assembly of said inside sash is slid vertically to an open position, said intermediate sash lower window light assembly including means removably and slidably supporting said intermediate sash lower window light assembly in the lower portion of the other ones of said intermediate sash side channels associated with each of said side framing plates which are the closest of the two contiguous intermediate sash side channels to said inside sash;

an outer sash upper window light assembly dimensioned to pass through the opening in said rectangular inside window sash when said lower window panel assembly of said inside window sash is slid vertically to an open position, and further dimensioned to pass through the opening defined between said side framing plates, top plate and the first and second series of flanges carried thereon, respectively, when said intermediate sash lower window light assembly is slid vertically to an open position in substantial horizontal alignment with said intermediate sash upper window light assembly, said outer sash upper window light assembly including means supporting said outer sash upper window light assembly in the upper portion of the ones of said outer sash side channels associated with each of said side frame member plates which are spaced farthest from the inside sash and from said intermediate sash of said two contiguous outer sash side channels; and an outer sash lower window light assembly dimensioned to pass through the opening in said rectangular inside window sash when said lower window sash assembly of said inside sash is slid vertically to an open position, and further dimensioned to pass through the opening defined between said side framing plates, top plate and the first and second series of flanges carried thereon, respectively, when said intermediate sash lower window light assembly is slid vertically to a position in which it is substantially aligned with said intermediate sash upper window light assembly, said outer sash lower window light assembly including means slidably and removably supporting said outer sash lower window light assembly in the lower portion of the ones of the contiguous outer sash side channels associated with each of said side framing plates which are spaced relatively closer to said intermediate sash and inside sash than are the contiguous outer sash side channels in which said outer sash upper window light assembly is supported.

2. A window assembly as defined in claim 1 and further characterized as including a sill plate extending across and interconnecting the lower ends of said side framing plates and supporting said intermediate sash lower window light assembly and said outer sash lower window light assembly.

3. A window assembly as defined in claim 1 and further characterized as including a screen panel assembly associated with said outer sash and including means supporting the screen panel assembly in the lower portion of the ones of said outer sash side channels in which said upper window light assembly is supported and at a location substantially horizontally aligned with said outer sash lower window light assembly.

4. A window assembly as defined in claim 1 wherein each of said first series of flanges includes:

a first flange extending in coplanar alignment with said peripheral mounting flange;

an intermediate flange spaced horizontally from said first flange and defining with said first flange, one of said contiguous intermediate sash side channels; and a third flange of wider dimension than said intermediate flange and thus projecting a greater distance from the respective side framing plate upon which it is carried toward said other side framing plate than do said first and intermediate flanges, and forming with said intermediate flange the second one of said contiguous intermediate sash side channels.

5. A window assembly as defined in claim 1 wherein each of said third series of flanges includes:

a first flange spaced from an adjacent one of said side framing plates toward the other of said side framing plates and positioned closer to said other framing plate than any of the flanges in said first series of flanges carried on said one side framing plate;

an intermediate flange spaced horizontally from said first flange of said third flange series and defining therewith one of said contiguous outer sash side channels, said intermediate flange of said third flange series being spaced from said adjacent one of said framing plates toward the other of said side framing plates, and positioned closer to said other framing plate than any of the flanges in said first series of flanges carried on said one side framing plate; and a third flange of wider dimension than each of said third flange series first flange and intermediate flange and projecting further toward said other side framing plate than the first and intermediate flanges of said third series.

6. A window assembly as defined in claim 4 wherein said first flange in each of said first series of flanges defines a notch located about one-fourth of the distance from the lower end of said first flange to the upper end thereof; and wherein each of said intermediate sash upper and lower window light assemblies include locking pegs dimensioned and spaced from each other to concurrently pass through the notches in each of said first flanges in the two first series of flanges, said spacing from each other being such that portions of the locking pegs are spaced a greater distance than adjacent edges of said first flanges are spaced from each other.

7. A window assembly as defined in claim 1 wherein each of said means slidably and removably supporting each of said window light assemblies in the respective side channels includes:

a pair of outwardly projecting guide pins on opposite sides of the respective window light assembly;

a pair of outwardly projecting locking pegs on opposite sides of the respective window light assembly and spaced from said guide pins; and a pair of retractable latches projecting from opposite sides of the respective window light assembly and spaced from said guide pins.

8. A window assembly as defined in claim 1 and further characterized as including a spacer frame slidably positioned below said intermediate sash upper window light assembly in the lower portion of the channels in which said intermediate sash upper window light assembly is slidably and removably supported.

9. A window assembly as defined in claim 8 wherein said means slidably and removably supporting each of said window light assemblies in the respective side channels includes:

a pair of outwardly projecting guide pins on opposite sides of the respective window light assembly;

a pair of outwardly projecting locking pegs on opposite sides of the respective window light assembly and spaced from said guide pins; and a pair of retractable latches projecting from opposite sides of the respective window light assembly and spaced from said guide pins.

10. A window assembly as defined in claim 7 wherein each of said third series of flanges includes:

a first flange spaced from an adjacent one of said side framing plates toward the other of said side framing plates and positioned closer to said other framing plate than any of the flanges in said first series of flanges carried on said one side framing plate;

an intermediate flange spaced horizontally from said first flange of said third flange series and defining therewith one of said contiguous outer sash side channels, said intermediate flange of said third flange series being spaced from said adjacent one of said side framing plates toward the other of said side framing plates, and positioned closer to said other framing plate than any of the flanges in said first series of flanges carried on said one side framing plate; and a third flange of wider dimension than each of said third flange series first flange and intermediate flange and projecting further toward said other side framing plate than the first and intermediate flanges of said third series.

11. A window assembly as defined in claim 8 wherein each of said third series of flanges includes:

a first flange spaced from an adjacent one of said side framing plates toward the other of said side framing plates and positioned closer to said other framing plate than any of the flanges in said first series of flanges carried on said one side framing plate;

an intermediate flange spaced horizontally from said first flange of said third flange series and defining therewith one of said contiguous outer sash side channels, said intermediate flange of said third flange series being spaced from said adjacent one of said side framing plates toward the other of said side framing plates, and positioned closer to said other framing plate than any of the flanges in said first series of flanges carried on said one side framing plate; and a third flange of wider dimension than each of said third flange series first flange and intermediate flange and projecting further toward said other side framing plate than the first and intermediate flanges of said third series.

12. A window assembly as defined in claim 11 wherein each of said first series of flanges includes:

a first flange extending in coplanar alignment with said peripheral mounting flange;

an intermediate flange spaced horizontally from said first flange and defining with said first flange, one of said contiguous intermediate sash side channels; and a third flange of wider dimension than said intermediate flange and thus projecting a greater distance from the respective side forming plate upon which it is carried toward said other side framing plate than do said first and intermediate flanges, and forming with said intermediate flange the second one of said contiguous intermediate sash side channels.

13. A window assembly as defined in claim 12 and further characterized as including a screen panel assembly associated with said outer sash and including means supporting the screen panel assembly in the lower portion of the ones of said outer sash side channels in which said upper window light assembly is supported and at a location substantially horizontally aligned with said outer sash lower window light assembly.

14. A window assembly as defined in claim 8 and further characterized as including a sill plate extending across and interconnecting the lower ends of said side framing plates and supporting said intermediate sash lower window light assembly and said outer sash lower window light assembly.

15. A window assembly as defined in claim 13 and further characterized as including a sill plate extending across and interconnecting the lower ends of said side framing plates and supporting said intermediate sash lower window light assembly and said outer sash lower window light assembly.

16. A multiple channeled, double-sash storm window structure adapted for attachment to a conventional window sash to form a triple-sash, double-hung window assembly, said structure comprising:

a vertically extending rectangular frame subassembly which includes:

a multiple channeled, double-sash frame open at one side and providing an internal first sash and an external second sash; and a sill plate extending across the one open side of the frame to complete the rectangular configuration of the frame subassembly;

a first, substantially rectangular lower window light assembly in said first sash of said frame and resting on said sill plate;

a first, substantially rectangular upper window light assembly in said first sash of said frame and disposed above said first lower window light assembly;

a second, substantially rectangular lower window light assembly in said second sash of the frame and resting upon said sill plate;

a second, substantially rectangular upper window light assembly in said second sash of the frame and disposed above said second lower window light assembly, said second upper and lower window light assemblies being of lesser length and width than said first upper and lower window light assemblies, said multiple channeled, double-sash frame comprising:

a top plate;

a pair of opposed, parallel horizontally spaced side framing plates having upper ends interconnected by said top plate;

a peripheral mounting flange secured to said top plate and to said side framing plates and adapted for securing said multiple channeled, double-sash storm window structure over a window opening and adjacent a conventional window sash;

first flange means on each of said side framing plates and each defining a first vertically extending side channel, said side channels being horizontally spaced from each other and together forming a portion of the internal first sash and removably receiving said first lower window light assembly;

second flange means on each of said side framing plates and each defining with a portion of said first flange means, a second vertically extending side channel, said second vertically extending side channels being horizontally spaced and lying in a first plate extending parallel to said first vertically extending side channels, said second vertically extending side channels together forming a portion of said internal first sash and removably receiving said first upper window light assembly;

third flange means on each of said side framing plates and each spaced horizontally from said second flange means and located on the opposite side of said second flange means from said first flange means, said second flange means each defining a third vertically extending side channel, said third side channels being horizontally spaced from each other and lying in a second plane extending parallel to, and horizontally spaced from, said first plane, and further forming a portion of said external second sash, and removably and slidably receiving said second lower window light assembly, said third flange means on said side framing plates, and the third vertically extending channels defined thereby, being horizontally spaced from each other by a lesser distance than said first flange means are spaced from each other, and by a lesser distance than said second flange means are spaced from each other; and fourth flange means on each of said side framing plates and each defining with said third flange means a fourth vertically extending side channel contiguous to said third vertically extending side channel, said fourth vertically extending side channels being horizontally spaced from each other and lying in a third plane extending parallel to said first and second planes, said fourth vertically extending side channels together forming a portion of said external second sash and removably receiving said second upper window light assembly, said fourth vertically extending flange means on said side framing plates, and the fourth vertically extending channels defined thereby, being horizontally spaced from each other by a lesser distance than said first flange means are horizontally spaced from each other, and by a lesser distance than said second flange means are horizontally spaced from each other;

whereby said second upper window light assembly and said second lower window light assembly can be passed through the opening defined between said first flange means and between said second flange means prior to the time when said first upper window light assembly and said first lower window light assembly are mounted in said first and second vertically extending side channels.

17. The storm window structure as defined in claim 16 and further characterized as including a spacer frame supported in said second vertically extending channel and positioned therein below said first upper window light assembly.

18. The storm window structure as defined in claim 16 and further characterized as including a screen panel assembly supported in said vertically extending side channel and positioned therein below said second upper window light assembly.

19. The storm window structure as defined in claim 16 wherein each of said first and second lower window light assemblies includes means for removably and slidably supporting the respective window light assembly in one of said vertically extending side channels.

* * * * *